US005427186A

United States Patent [19]

Adrian et al.

[11] Patent Number: 5,427,186

[45] Date of Patent: Jun. 27, 1995

[54] METHOD FOR FORMING WEAR SURFACES AND THE RESULTING PART

[75] Inventors: Richard L. Adrian, Dunlap; James C. Henehan, Wyoming; Phillip J. Shankwitz, Peoria, all of Ill.

[73] Assignee: Caterpillar Inc., Peoria, Ill.

[21] Appl. No.: 170,622

[22] Filed: Dec. 20, 1993

[51] Int. Cl.[6] ..... E02F 3/80

[52] U.S. Cl. ..... 172/701.3; 172/772; 172/747; 37/446; 37/460; 29/509; 29/469.5

[58] Field of Search ..... 172/772, 772.5, 701.3, 172/811, 747; 37/446, 460; 148/529; 419/48, 50, 10, 14, 19; 29/509, 897, 469.5; 228/265, 235.2

[56] References Cited

U.S. PATENT DOCUMENTS

| | | | |
|---|---|---|---|
| 3,165,822 | 1/1965 | Beeghly | 29/182.7 |
| 3,490,901 | 1/1970 | Hachisuka et al. | 75/203 |
| 3,529,677 | 9/1970 | Stephenson | 172/701.3 |
| 3,805,423 | 4/1974 | Engel et al. | 37/142 R |
| 4,052,802 | 10/1977 | Moen et al. | 37/141 R |
| 4,086,966 | 5/1978 | Lanz et al. | 172/767 |
| 4,101,318 | 7/1978 | Rudy | 75/240 |
| 4,300,951 | 11/1981 | Hachisuka | 75/236 |
| 4,624,830 | 11/1986 | Barr | 419/7 |
| 4,704,251 | 11/1987 | Kraemer | 419/17 |
| 4,715,450 | 12/1987 | Hallissy et al. | 172/701.3 |
| 4,719,076 | 1/1988 | Geczy et al. | 419/8 |
| 4,770,253 | 9/1988 | Hallissy et al. | 172/701.3 |
| 4,923,511 | 5/1990 | Krizan et al. | 75/252 |
| 5,032,352 | 7/1991 | Meeks et al. | 419/8 |
| 5,111,600 | 5/1992 | Lukavich et al. | 37/141 T |
| 5,224,555 | 7/1993 | Bain | 172/772.5 |

FOREIGN PATENT DOCUMENTS

| | | | |
|---|---|---|---|
| 2423963 | 12/1974 | Germany | 172/701.3 |

*Primary Examiner*—Randolph A. Reese
*Assistant Examiner*—Spencer Warnick
*Attorney, Agent, or Firm*—Kenneth A. Rhoads

[57] ABSTRACT

A method for forming a blade adapted to be attached to an earthworking vehicle and the resultant wear resistant blade has a wear surface assembly which includes a carbide insert sandwiched between a steel plate and a composite material within a pocket on the front surface of the blade spaced from the blade cutting edge.

15 Claims, 2 Drawing Sheets

METHOD FOR FORMING WEAR SURFACES AND THE RESULTING PART

TECHNICAL FIELD

The present invention relates to a method for forming wear surfaces on a steel part and the part resulting from this method.

BACKGROUND ART

Much industrial effort has been devoted to developing ground-engaging tools with a reduced cost to wear life ratio. For example, new material compositions and heat treatments have been responsible for lowering the wear rates of cutting edges for earthworking blades and the tips for penetrating teeth. Moreover, various hard-facing materials have been weldingly applied to the exposed wear surfaces of such tools. Unfortunately, these thin hard facings wear away relatively quickly and it is necessary to apply additional layers at considerable expense of labor, time, equipment and the waste of natural resources.

Particularly promising are those activities relating to the use of composite wear-resistant particles in a tough carrying matrix material. These composite materials are typically deposited on the tool or are made into inserts.

In addition to economic considerations, these composite materials must be located in optimum locations on the tool because they tend to crack or fail by spalling under the severe working conditions frequently encountered by large earthworking vehicles.

The present invention is directed to overcome and improve upon one or more of the problems as set forth above.

DISCLOSURE OF THE INVENTION

In one aspect of the invention, an elongated cutting blade adapted for connection to an earth working vehicle is provided with a wear surface assembly. The blade has an elongated cutting edge, a front surface, a rear surface, and an elongated wear surface assembly formed on the blade. The blade is formed of a first material and the wear surface assembly is formed of differing materials.

The wear surface assembly has an outer surface, a bottom, and sidewalls. The outer surface is generally coplaner with the front surface of the blade. The wear surface assembly extends from the outer surface into the blade to a preselected depth (d) and extends over substantially the entire length of the blade at a location spaced a preselected distance (s) from the blade cutting edge. The wear surface assembly has the assembly bottom formed of a composite material including ceramic particles and steel. A lower portion of the sidewalls is formed of the composite material. An upper portion of the sidewalls and outer surface of the assembly is formed of steel. An internal central portion of the assembly is a carbide insert. The width (w) of the bottom surface of the assembly is less than the width (W) of the assembly outer surface.

In another aspect of the invention, a method is provided for forming an elongated wear surface on an earthworking blade which has a cutting edge, a first surface, and a rear surface. An elongated groove is formed which has sidewalls along the front surface of the blade spaced a preselected distance (s) from the blade cutting edge. A composite material is provided which is formed of ceramic particles and powdered steel. At least one elongated carbide insert which has sidewalls is provided. The bottom of the elongated groove is substantially covered with the composite material. The carbide insert is positioned within the groove and in contact with the composite material. Composite material is then positioned between the groove sidewalls and sidewalls of the blade and a steel plate is positioned partially within the blade groove and substantially covering the width of the groove over substantially the entire length of the groove. The blade assembly is then heated to a temperature of at least 2000 degrees F. and then sufficient pressure is applied to the steel plate to deform the steel plate into the groove and consolidate the composite material.

BEST MODE FOR CARRYING OUT THE INVENTION

Figure 1:
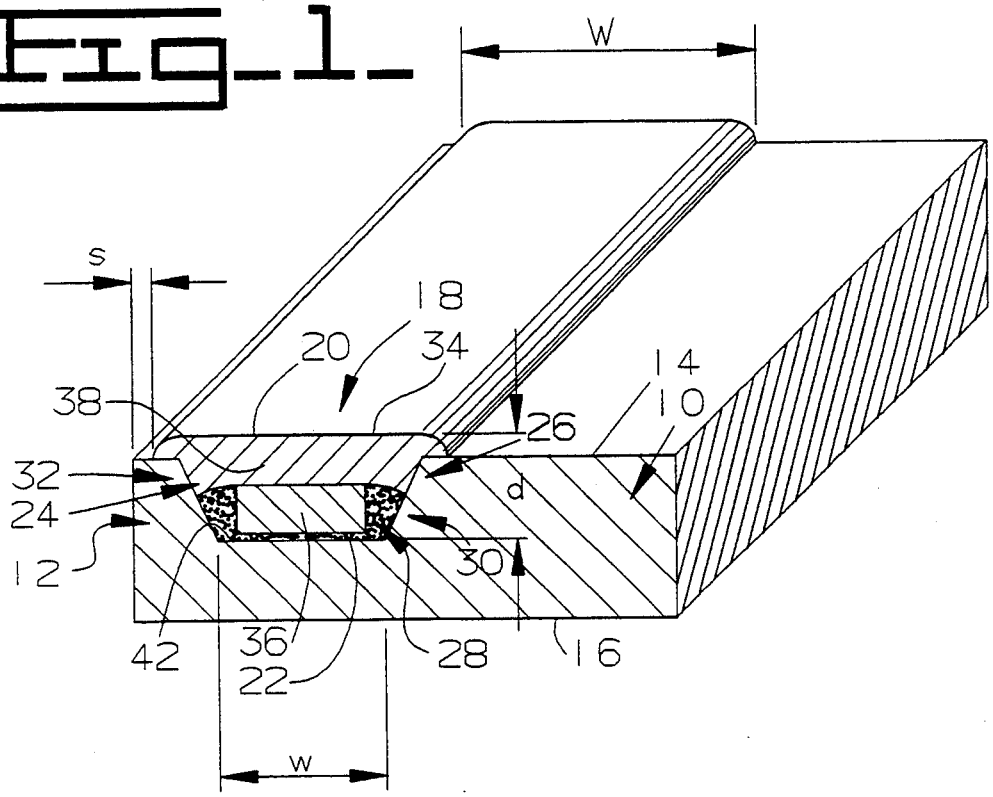
FIG. 1 shows the blade of this invention having a wear surface assembly.

Referring to FIG. 1, an elongated cutting blade 10 is adapted for connection to all earth working vehicle (not shown). The blade 10 has an elongated cutting edge 12, a front surface 14, a rear surface 16, and an elongated wear surface assembly 18 formed on the blade 10. The blade 10 is formed of a first material and the wear surface assembly 18 is formed of differing materials as hereinafter more fully described.

The wear surface assembly 18 has an outer surface 20, a bottom 22, and first and second sidewalls 24,26. The outer surface 20 is generally coplaner with the front surface 14 of the blade 10.

The wear surface assembly 18 extends from the outer surface 20 into the blade 10 to a preselected depth (d) and also extends over substantially the entire length of the blade 10 at a location spaced a preselected distance (s) from the blade cutting edge 12.

The wear surface assembly bottom 22 is formed of a composite material 28 which includes ceramic particles and steel. A lower portion 30 of the sidewalls 24,26 of the assembly is formed of the composite material 28 and an upper portion 32 of the assembly sidewalls 24,26 is formed of steel. An internal central portion 34 of the assembly 18 is a carbide insert 36. The width (w) of the bottom 22 of the assembly is less than the width (W) of the assembly outer surface 20.

The ceramic particles of the composite material 28 can be one of tungsten carbide, aluminum oxide, zirconium oxide, chrome oxide, silicon dioxide, silicon nitride, silicon carbide, chrome carbide, diamond or mixtures thereof. The steel of the composite material 28 is SAE 4630 or plain carbon to high alloy steel powder. The steel of the assembly outer surface 20 is an elongated steel plate 38 formed of plain carbon to alloy steel depending on the blade's application, as is known in the art. In a preferred embodiment, the composite material 28 is formed of about 1 weight, percent cellulose acetate binder, about 60 weight percent tungsten carbide and about 39 weight percent SAE 4630 steel in powdered metal form.

The carbide insert cross-section 36 is preferably of a rectangular configuration. The carbide insert 36 can also be formed as a continuous piece or of a plurality of pieces abutting one another in the groove of the blade 10. In a preferred embodiment the unitary carbide insert is formed of about 7 weight percent cobalt and about 93 weight percent tungsten carbide. However, this ratio can vary depending on the application without departing from this invention.

The wear surface assembly sidewalls 24,26 each extend outwardly at an angle from vertical to the bottom 22 of at least five degrees.

Figure 2:
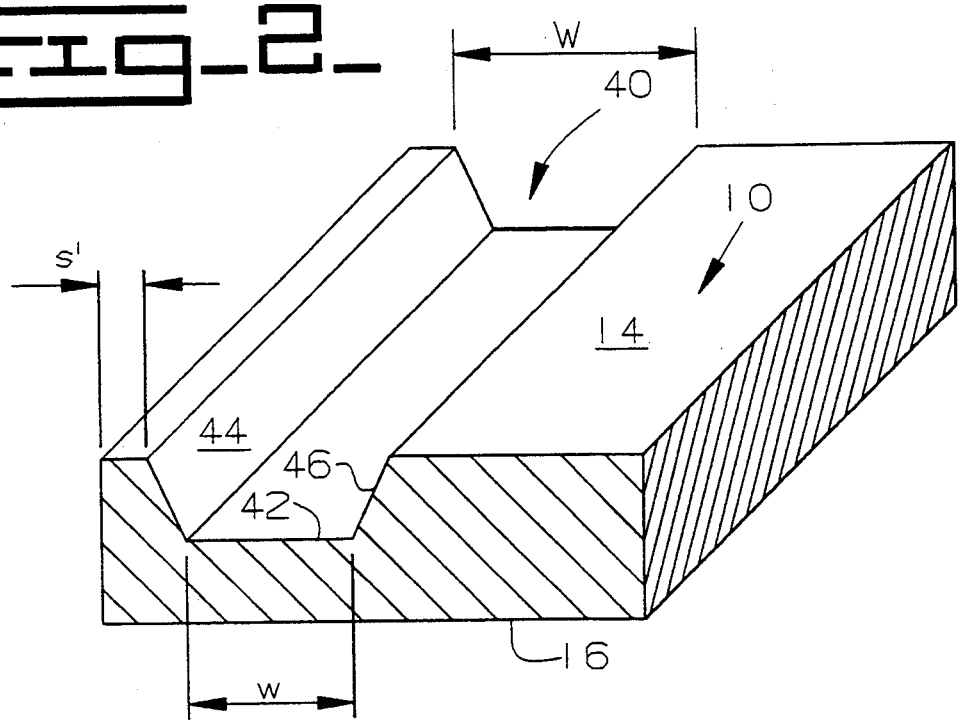
FIG. 2 shows the blade prior to installing the wear surface assembly.

In the method of forming the apparatus as set forth above, the wear surface assembly 18 is formed on the earthworking blade 10 which has the cutting edge 12, front surface 14 and rear surface 16, as set forth above. Referring to FIG. 2, an elongated groove 40 is formed along the front surface 14 of the blade 10 a preselected distance (s) spaced from the blade edge 12.

The groove 40 has a bottom 42, first and second groove sidewalls 44,46 and the groove 40 opens on the front surface 14 of the blade 10. The groove has a width (W) on the plane of said front surface 14 that is greater in magnitude than the groove width (w) at the groove bottom 42.

Figure 3:
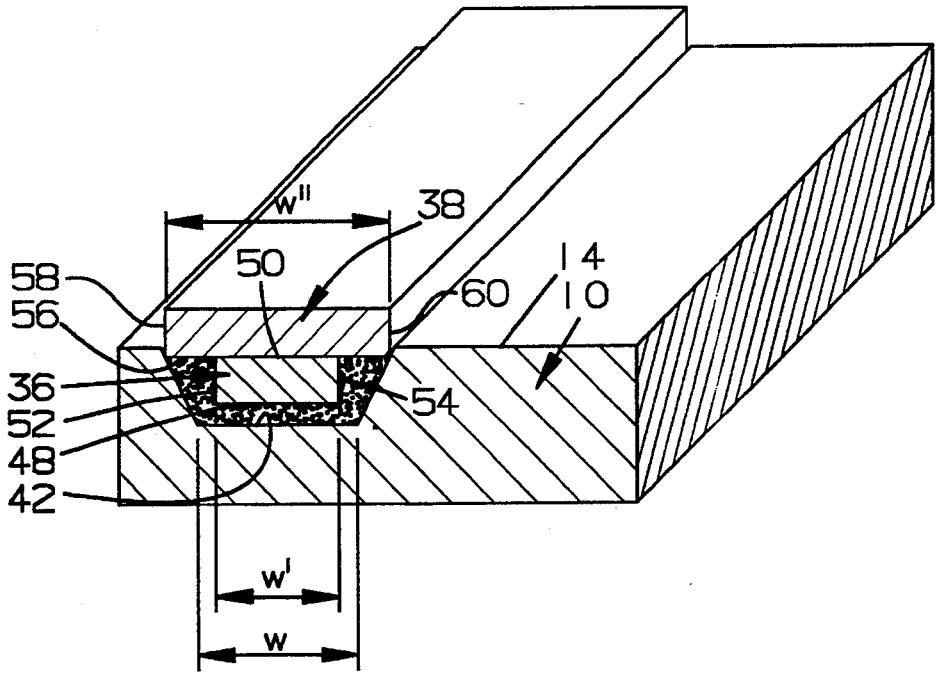
FIG. 3 shows the blade of this invention prior to the heating and forming step.

Referring to FIG. 3, the carbide insert 36 has a bottom 48, a top 50, and first and second sidewalls 52,54. The insert bottom 48 has a width (w') less than the bottom of the groove bottom width (w) and the insert sidewalls 52,54 extend from the insert bottom 48 in a direction toward the front surface 14 of the blade 10. The angle between the insert sidewalls 52,54 and a plane extending perpendicularly to the plane of the bottom 48 of the insert 36 is less than the angle between the groove sidewalls 44,46 and a plane extending perpendicularly to the bottom 42 of the groove 40.

Referring to FIGS. 1 and 3, the bottom 42 of the elongated groove 40 is covered with the composite material 28, the carbide insert 36 is placed within the groove 40 with the insert sidewalls 52,54 spaced from the groove sidewalls 44,46. Composite material 28 is then placed between the sidewalls 44,46 of the groove 40 and the sidewalls 52,54 of the insert 36.

The elongated steel plate 38 (FIG. 3) is placed within the groove 40. The plate 38 has a bottom surface 56, first and second sidewalls 58,60 and a width (w'') slightly less than the groove width (W). For example, in a groove 40 having a depth (d) of 12 mm, and a width (W) of 37 mm, the width (w'') of the plate 38 is 36 mm. Therefore, only a portion of the thickness of the plate 38 is positioned within the groove 40 in the installed position.

The composite material 28, carbide insert 36 and plate 38 define the wear surface assembly 18 positioned within the groove 40 of the blade 10. The wear surface assembly 18 is thereafter heated in a furnace to a temperature of at least 2,000 degrees F. and pressure is applied to the plate 38 with a force sufficient to deform the steel plate 38 into the groove 40 and consolidate the composite material 28 as seen in FIG. 1.

The pressure is preferably applied by passing the blade through a rolling mill a sufficient number of times. Example pressures that are applied on any single pass through the mill are at least 75,000 psia. However, it should be understood that the pressure applied and the number of passes through the mill that are required to sufficiently deform the plate 38 and consolidate the composite material 28 are functions of the dimensions and volumes off the wear surface assembly and one skilled in the art can determine the optimum variables without undue experimentation.

INDUSTRIAL APPLICABILITY

Figure 4:
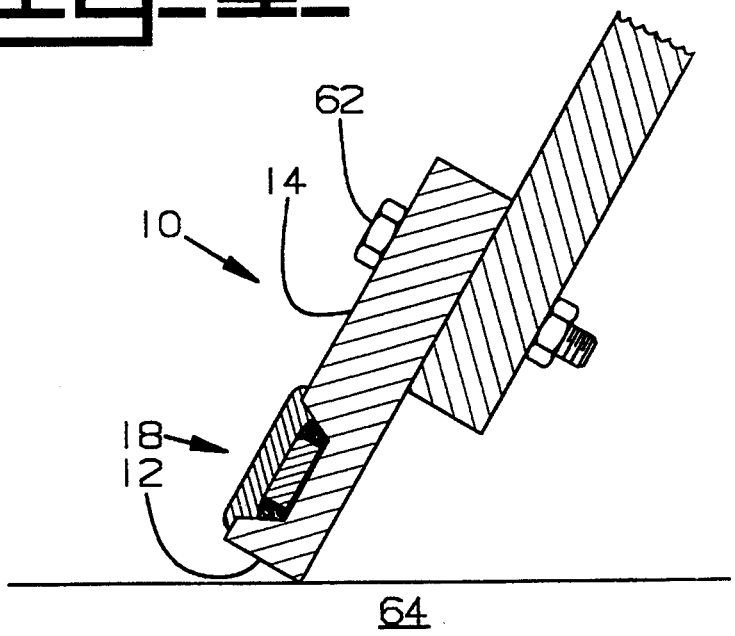
FIG. 4 shows the finished blade installed on an earthworking vehicle.

Referring to FIG. 4, the blade 10 is attached to an earthworking vehicle, for example the lower surface of a motor grader, by bolts 62. As the front surface 14 of the blade 10 moves through the ground during operation, the cutting edge 12 of the blade 10 wears in a normal manner. However, as the cutting edge 12 wears, the wear surface assembly 18 is exposed. The wear surface assembly 18 has greater wear resistant properties and the rate of wear of the blade 10 is greatly diminished. The configuration of the assembly 18 is of a configuration and the elements of the assembly are such that the heretofore mentioned problems are reduced.

Other aspects, objects and advantages of this invention can be obtained from a study of the drawings, the disclosure and the appended claims.

What is claimed is:

1. An elongated cutting blade adapted for connection to an earth working vehicle, said blade having an elongated-cutting edge, a front surface, a rear surface, an elongated wear surface assembly formed on the blade, said blade being formed of a first material and said wear surface assembly being formed of differing materials, comprising:

said wear surface assembly having an outer surface, a bottom, and sidewalls, said outer surface being generally coplaner with the front surface of the blade, said wear surface assembly extending from the outer surface into the blade to a preselected depth (d) and extending over substantially the entire length of the blade at a location spaced a preselected distance (s) from the blade cutting edge, said wear surface assembly having said assembly bottom being formed of a composite material including ceramic particles and steel, a lower portion of the sidewalls formed of the composite material, an upper portion of the sidewalls formed of steel, and said outer surface being formed of steel and an internal central portion being a carbide insert, the width (w) of said assembly bottom being less than the width (W) of said assembly outer surface.

2. The cutting blade, as set forth in claim 1, wherein the composite material ceramic particles include one of tungsten carbide, silicon carbide, chrome carbide, and aluminum oxide.

3. The cutting blade, as set forth in claim 1, wherein the composite material steel is SAE 4630 steel.

4. The cutting blade, as set forth in claim 1, wherein the wear surface assembly outer surface steel is SAE 4630 steel.

5. The cutting blade, as set forth in claim 1, wherein the composite material is formed from carbide particles in powdered metal.

6. The cutting blade, as set forth in claim 1, wherein the composite material is formed of about 60 weight percent tungsten carbide particles, about 39 weight percent SAE 4630 steel in the form of powdered metal, and the remainder weight percent being cellulose acetate binder.

7. The cutting blade, as set forth in claim 1, wherein the carbide insert cross-section is of general rectangular configuration.

8. The cutting blade, as set forth in claim 1, wherein the carbide insert is formed of a plurality of carbide elements.

9. The cutting blade, as set forth in claim 1, wherein the carbide insert is formed of about 7 weight percent cobalt and about 93 weight percent tungsten carbide.

10. The cutting blade, as set forth in claim 1, wherein the wear surface assembly sidewalls each extend outwardly at an angle from vertical to the bottom of at least five degrees.

11. A method for forming an elongated wear surface on an earthworking blade having an earth cutting edge, a first surface, and a rear surface, comprising:

forming an elongated groove having a bottom and sidewalls, one of said sidewalls extending along the first surface of the blade spaced a preselected distance (s) from the blade cutting edge;

providing a composite material formed of ceramic particles and powdered steel;

providing at least one elongated carbide insert having sidewalls;

substantially covering the bottom of the elongated groove with said composite material;

positioning the carbide insert within the groove and in contact with the composite material;

positioning composite material between the groove sidewalls and sidewalls of the carbide insert;

positioning an elongated steel plate partially within the blade groove and substantially covering the width of the groove over substantially the entire length of the groove;

heating the blade assembly to a temperature of at least 2,000 degrees F.; and applying sufficient pressure on the steel plate to deform the steel plate into the groove and consolidate the composite material.

12. A method, as set forth in claim 11, wherein pressures of at least 75,000 psia are applied to the steel plate.

13. A method, as set forth in claim 11, wherein the pressures are applied by a rolling mill.

14. A method, as set forth in claim 13, wherein the pressures are applied a plurality of times.

15. A method for forming an elongated wear surface on an earthworking blade having an earth cutting edge, a front surface and a rear surface, comprising:

forming an elongated groove along the front surface of the blade, said groove being spaced a preselected distance (s) from said blade edge, said groove having a bottom, sidewalls and opening on the front surface of the blade, said groove having a width (W) on the plane of said front surface that is greater than the groove width (w) at the groove bottom;

providing a composite material formed of ceramic particles and steel powder;

providing an elongated carbide insert having a bottom and sidewalls, said insert bottom having a width (w′) less than the bottom of the groove width (w) and said insert sidewalls extending upwardly from the insert bottom, the angle between the insert sidewalls and a plane perpendicular to the bottom of the insert being less than an angle between the groove sidewalls and a plane perpendicular to the bottom of the groove;

substantially covering the bottom of the elongated groove with said composite material;

placing the elongated carbide insert within the blade groove with the insert bottom resting on the composite material within the groove and with the insert sidewalls spaced from the groove sidewalls;

placing composite material within the groove between the sidewalls of the groove and the sidewalls of the insert;

providing an elongated steel plate having a bottom surface, first and second sidewalls, and a width (w″) slightly less than the groove width (W);

placing the elongated steel plate within the blade groove with the plate bottom surface adjacent the insert with the junctures of the plate bottom surface and the plate sidewalls being within and contacting the groove sidewalls and forming a blade assembly portion of the blade;

heating the blade assembly to a temperature of at least 2,000 degrees F.;

applying sufficient pressure on the blade assembly portion to deform the steel plate into the groove and consolidate the composite material; and providing means on said blade for connecting the earthworking blade to a vehicle.

* * * * *